US010871006B1

(12) United States Patent
Stubbs

(10) Patent No.: US 10,871,006 B1
(45) Date of Patent: Dec. 22, 2020

(54) COLLAPSIBLE MOSQUITO NET ASSEMBLY

(71) Applicant: Quaneesha Stubbs, Indianapolis, IN (US)

(72) Inventor: Quaneesha Stubbs, Indianapolis, IN (US)

( * ) Notice: Subject to any disclaimer, the term of this patent is extended or adjusted under 35 U.S.C. 154(b) by 0 days.

(21) Appl. No.: 16/360,090

(22) Filed: Mar. 21, 2019

(51) Int. Cl.
*E04H 15/06* (2006.01)
*E04H 15/44* (2006.01)
*E04H 15/40* (2006.01)
*E04H 15/02* (2006.01)

(52) U.S. Cl.
CPC ..... *E04H 15/06* (2013.01); *E04H 15/02* (2013.01); *E04H 15/40* (2013.01); *E04H 15/44* (2013.01)

(58) Field of Classification Search
CPC ..... E04H 15/36; E04H 15/40; E04H 15/06; B62B 9/142; B60J 7/10
USPC ..... 135/137
See application file for complete search history.

(56) References Cited

U.S. PATENT DOCUMENTS 674,920 A * 5/1901 Jones ..... A47C 29/006 135/137
1,087,806 A * 2/1914 Miller ..... E04H 15/36 135/124
1,134,009 A * 3/1915 Reid ..... E04H 15/36 135/136
1,608,242 A * 11/1926 Sava ..... E04H 15/40 135/126
2,129,080 A * 9/1938 Bramnick ..... B62B 9/142 135/115
2,546,843 A 3/1951 Zigterman
2,927,331 A 3/1960 Ruiz
4,043,349 A * 8/1977 Gays ..... A47C 29/003 135/137
4,862,534 A 9/1989 Gomez-Marcial
4,961,981 A 10/1990 Keegan
D431,377 S 10/2000 Buggs
6,217,099 B1 4/2001 McKinney
6,263,894 B1 7/2001 LaMantia
6,505,880 B1 * 1/2003 Castro ..... B60J 7/10 160/DIG. 2
6,543,830 B1 * 4/2003 Stuck ..... B60J 5/0487 296/77.1
6,811,204 B2 * 11/2004 Long ..... E04H 15/40 135/88.05
6,859,958 B2 3/2005 LaMantia
7,147,263 B2 * 12/2006 Schneidau ..... B60J 1/20 296/77.1

(Continued)

*Primary Examiner* — Noah Chandler Hawk

(57) ABSTRACT

A collapsible mosquito net assembly includes a frame that has a plurality of members collapsibly coupled together. Thus, the frame is positionable between a collapsed position for storage and a deployed position has the frame defining a quonset. Additionally, the frame is positionable on top of a carriage when the frame is positioned in the deployed position. A mosquito net is coupled to the frame and the mosquito net covers the quonset defined by the frame when the frame is positioned in the deployed position. Thus, the mosquito net can protect an occupant of the carriage from mosquitoes. A border is coupled around the frame and a plurality of fasteners is each of the fasteners is coupled to the border. Each of the fasteners releasably engages the carriage when the frame is positioned on the carriage.

4 Claims, 5 Drawing Sheets

(56) References Cited

U.S. PATENT DOCUMENTS 7,854,463 B1 * 12/2010 Neumann ..... B62D 33/0621
296/144
8,444,174 B1 * 5/2013 Miller, Jr. ..... E04H 15/001
182/63.1
9,463,821 B1 * 10/2016 Critchley ..... B62B 9/10

* cited by examiner

COLLAPSIBLE MOSQUITO NET ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mosquito net devices and more particularly pertains to a new mosquito net device for PURPOSE.

BRIEF SUMMARY OF THE INVENTION

An embodiment of the disclosure meets the needs presented above by generally comprising a frame that has a plurality of members collapsibly coupled together. Thus, the frame is positionable between a collapsed position for storage and a deployed position has the frame defining a quonset. Additionally, the frame is positionable on top of a carriage when the frame is positioned in the deployed position. A mosquito net is coupled to the frame and the mosquito net covers the quonset defined by the frame when the frame is positioned in the deployed position. Thus, the mosquito net can protect an occupant of the carriage from mosquitoes. A border is coupled around the frame and a plurality of fasteners is each of the fasteners is coupled to the border. Each of the fasteners releasably engages the carriage when the frame is positioned on the carriage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
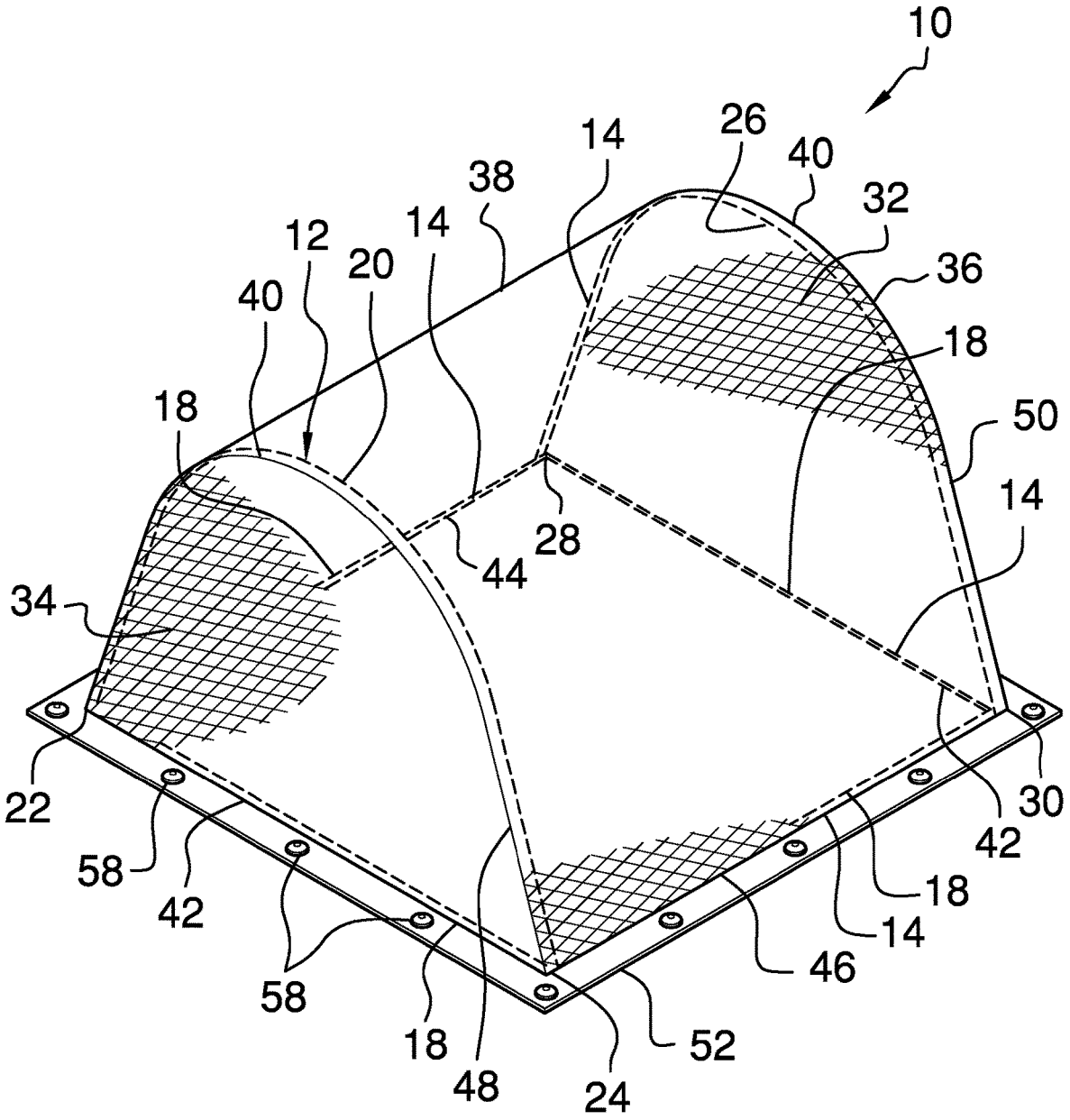
FIG. 1 is a perspective view of a collapsible mosquito net assembly according to an embodiment of the disclosure.
Figure 2:
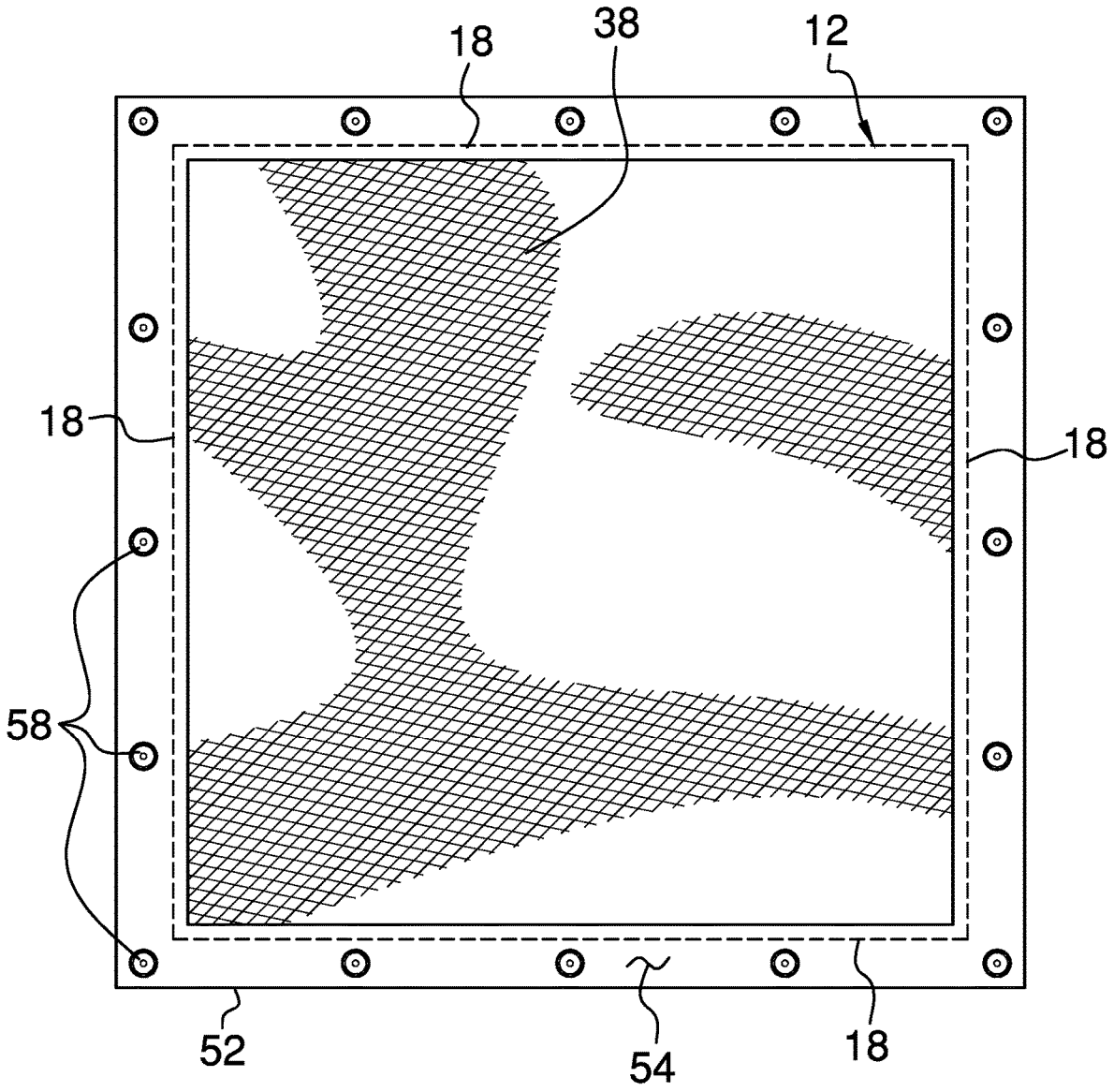
FIG. 2 is a bottom view of an embodiment of the disclosure.
Figure 3:
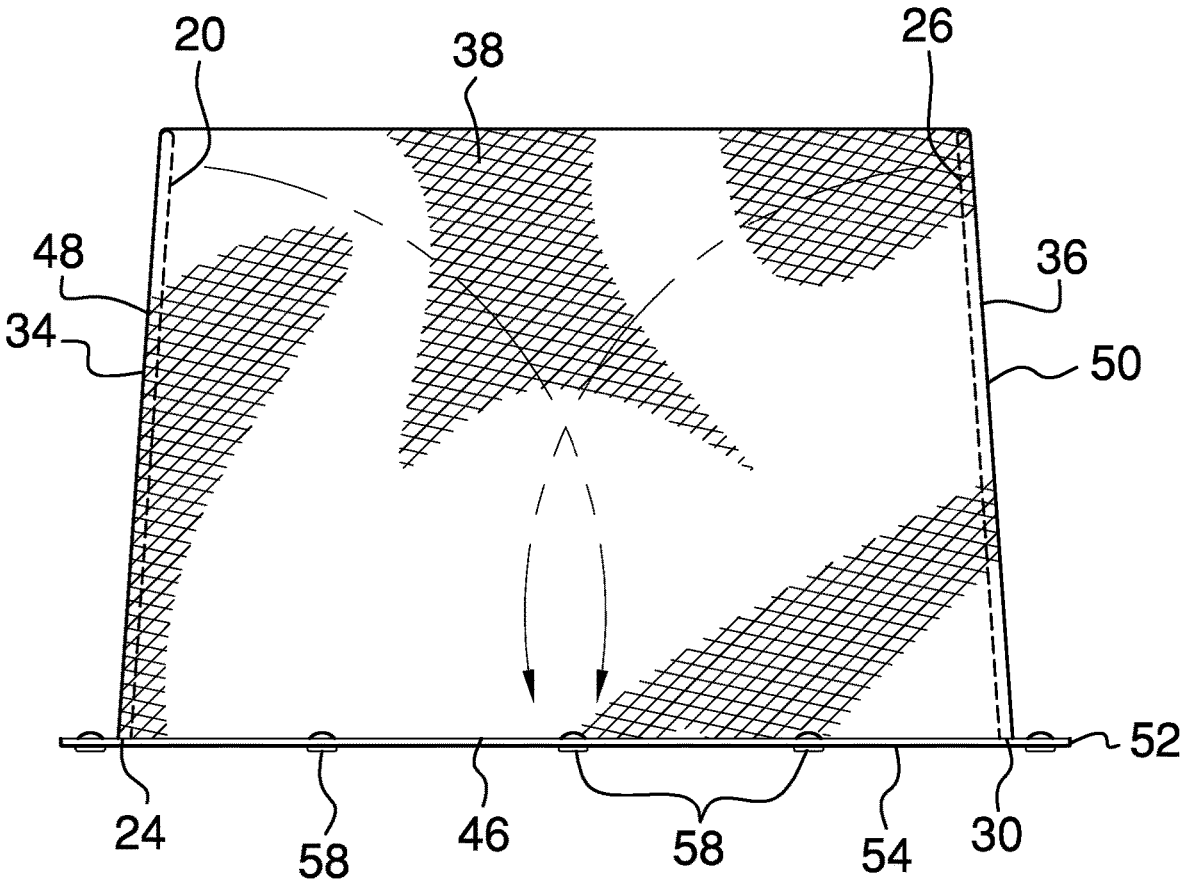
FIG. 3 is a right side view of an embodiment of the disclosure.
Figure 4:
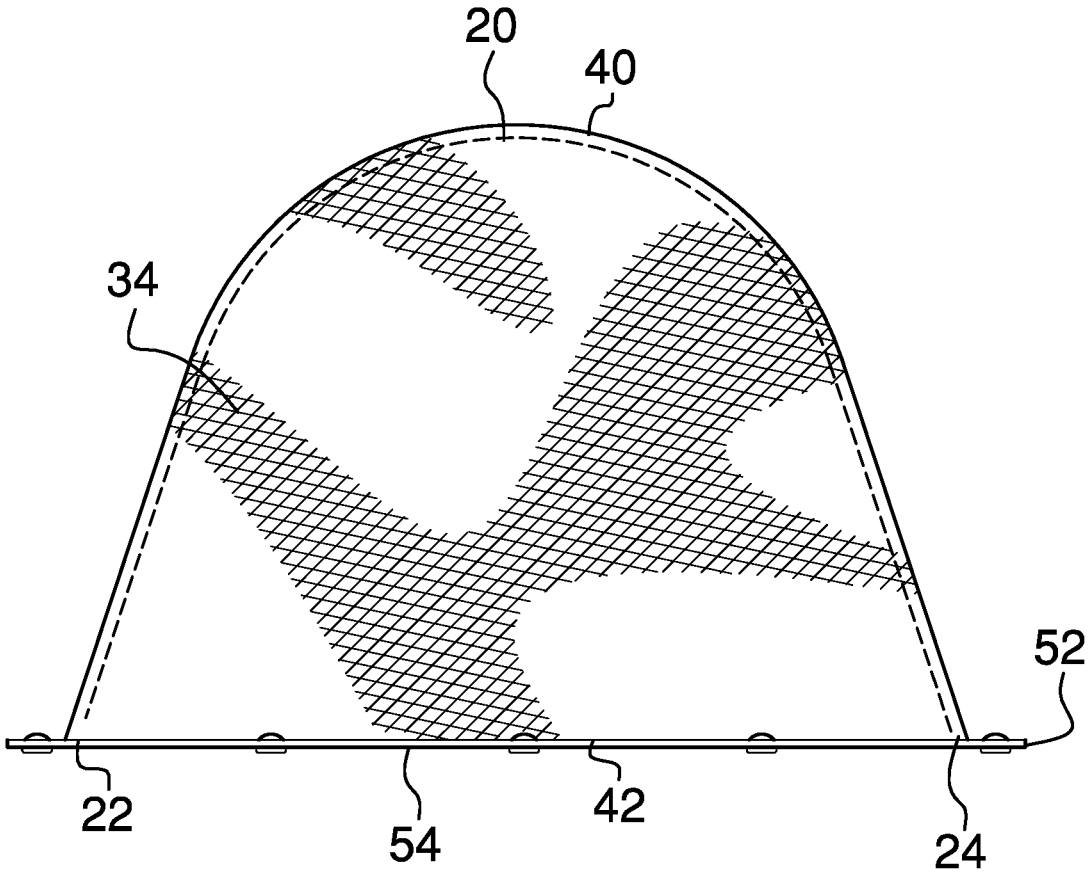
FIG. 4 is a front view of an embodiment of the disclosure.
Figure 5:
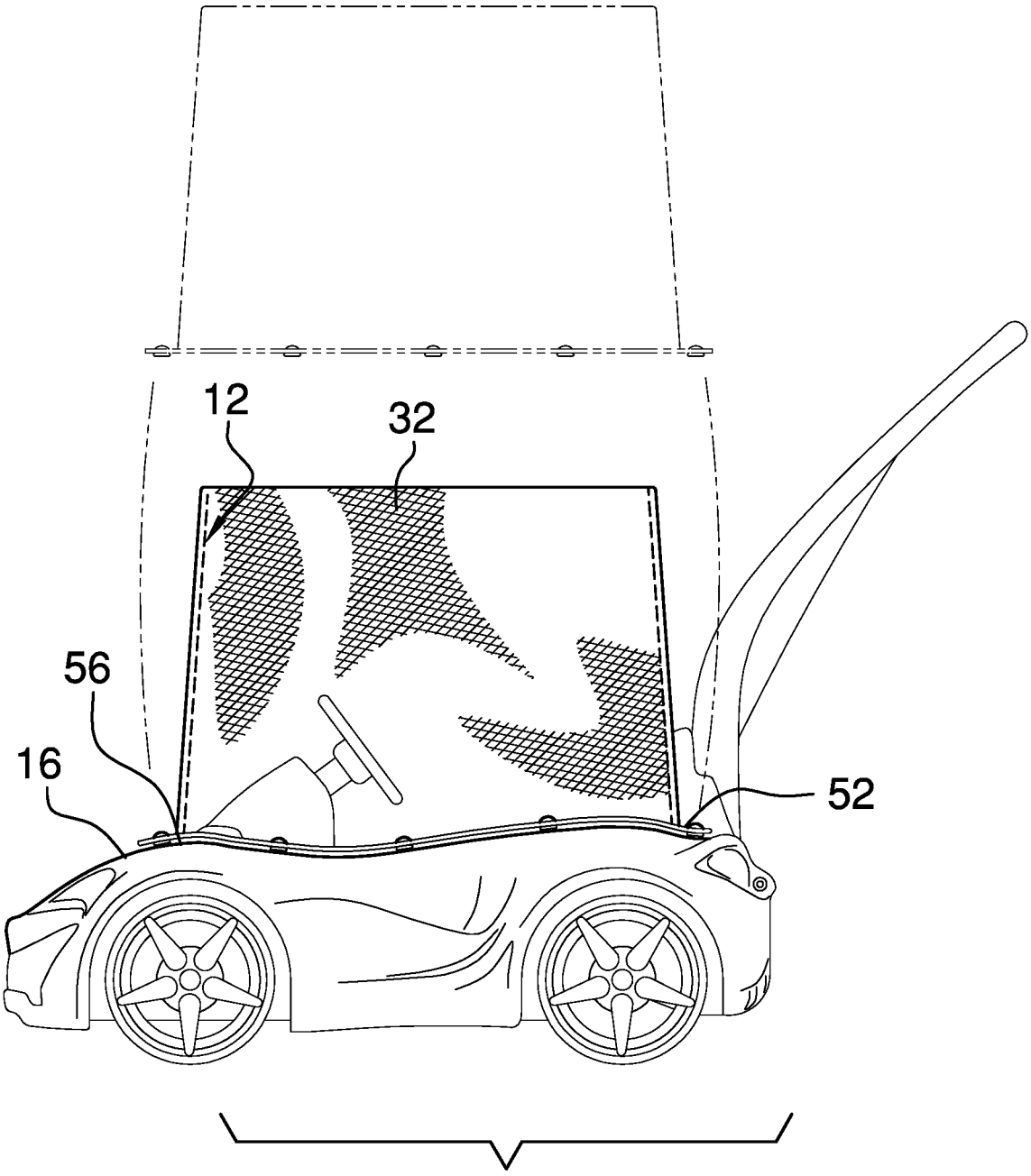
FIG. 5 is a perspective in-use view of an embodiment of the disclosure.

With reference now to the drawings, and in particular to FIGS. 1 through 5 thereof, a new mosquito net device embodying the principles and concepts of an embodiment of the disclosure and generally designated by the reference numeral 10 will be described.

As best illustrated in FIGS. 1 through 5, the collapsible mosquito net assembly 10 generally comprises a frame 12 that has a plurality of members 14 being collapsibly coupled together. Thus, the frame 12 is positionable between a collapsed position for storage and a deployed position having the frame 12 defining a quonset. Moreover, the frame 12 is positionable on top of a carriage 16 when the frame 12 is positioned in the deployed position. The carriage 16 may be a toddler playpen, a stroller, a bed, or any other rectilinear carriage 16 that has an open top.

The plurality of members 14 includes a plurality of base members 18 that are coupled together and are oriented at right angles with each other such that the base members 18 form a rectangle. The plurality of members 14 includes a first upright member 20 that has a first end 22 and a second end 24. Each of the first 22 and second 24 ends is movably coupled to a respective one of the base members 18 and each of the first 22 and second 24 ends is aligned with a respective one of four corners of the rectangle formed by the base members 18. Additionally, the first upright member 20 is curved between the first 22 and second 24 ends. The first upright member 20 curves upwardly from the respective base member 18 when the frame 12 is positioned in the deployed position. The first upright member 20 lies on a plane that is coplanar with the rectangle when the frame 12 is positioned in the collapsed position.

The plurality of members 14 includes a second upright member 26 that has a primary end 28 and a secondary end 30. Each of the primary 28 and secondary 30 ends is movably coupled to a respective one of the base members 18 and each of the primary 28 and secondary 30 ends is aligned with a respective one of four corners of the rectangle formed by the base members 18. Additionally, the second upright member 26 is curved between the primary 28 and secondary 30 ends. The second upright member 26 is positioned on an opposite side of the rectangle with respect to the first upright member 20. The second upright member 26 curves upwardly from the respective base member 18 when the frame 12 is positioned in the deployed position. Alternatively, the second upright member 26 lies on a plane that is coplanar with the rectangle when the frame 12 is positioned in the collapsed position.

A mosquito net 32 is coupled to the frame 12 and the mosquito net 32 covers the quonset defined by the frame 12 when the frame 12 is positioned in the deployed position. Thus, the mosquito net 32 protects an occupant of the carriage 16 from mosquitoes. The mosquito net 32 has a first end panel 34, a second end panel 36 and a middle panel 38. Each of the first 34 and second 36 end panels has an upper edge 40 and a lower edge 42. The upper edge 40 of each of the first 34 and second 36 end panels is coupled to a respective one of the first 20 and second 26 upright members. Additionally, the upper edge 40 is coextensive with the respective first 20 and second 26 upright member. The lower edge 42 of each of the first 34 and second 36 end panels is coupled to a respective one of the base members 18. Thus, each of the first 34 and second 36 end panels forms a respective end of the quonset when the frame 12 is positioned in the deployed position.

The middle panel 38 has a front edge 44, a back edge 46, a first lateral edge 48 and a second lateral edge 50. The first lateral edge 48 is coupled to the first upright member 20 and the second lateral edge 50 is coupled to the second upright member 26. Each of the front 44 and back 46 edges is coupled to a respective one of the base members 18. Thus, the middle panel 38 forms a roof of the quonset when the frame 12 is positioned in the deployed position.

A border 52 is coupled to and is coextensive with each of the base members 18 such that the border 52 extends around an entire perimeter of the rectangle formed by the base members 18. The border 52 has a lower surface 54 and the lower surface 54 rests on a top edge 56 of the carriage 16 when the frame 12 is positioned on the carriage 16. A plurality of fasteners 58 is each coupled to the border 52 and each of the fasteners 58 releasably engages the carriage 16 when the frame 12 is positioned on the carriage 16. Each of the fasteners 58 is positioned on the lower surface 54 of the border 52, and the fasteners 58 are spaced apart from each other and are distributed around the perimeter of the rectangle. Additionally, each of the fasteners 58 may comprise snaps, magnets or any other type of releasable fastener.

In use, the frame 12 is positioned in the deployed position to define the Quonset and the frame 12 is positioned over the carriage 16. Thus, the mosquito net 32 covers the carriage 16 and protects the occupant from mosquitoes. In this way a toddler can play in the carriage 16 while the carriage 16 is positioned outdoors without getting bitten by mosquitoes. Additionally, each of the fasteners 58 can be releasably coupled to the carriage 16 to retain the frame 12 on the carriage 16. The frame 12 is positioned in the collapsed position to store the frame 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible mosquito net assembly being mountable to a carriage wherein said assembly is configured to protect an occupant from mosquitoes, said assembly comprising:

a frame having a plurality of members being collapsibly coupled together thereby facilitating said frame to be positionable between a collapsed position for storage and a deployed position having said frame defining a quonset, said frame being positionable on top of a carriage when said frame is positioned in said deployed position;

a mosquito net being coupled to said frame, said mosquito net covering said quonset defined by said frame when said frame is positioned in said deployed position wherein said mosquito net is configured to protect an occupant of the carriage from mosquitoes;

a border being coupled around said frame;

a plurality of fasteners, each of said fasteners being coupled to said border, each of said fasteners releasably engaging the carriage when said frame is positioned on the carriage;

said plurality of members comprising a plurality of base members, said base members being coupled together and being oriented at right angles with each other such that said base members form a rectangle, a first upright member having a first end and a second end, each of said first and second ends being movably coupled to a respective one of said base members, each of said first and second ends being aligned with a respective one of four corners of said rectangle formed by said base members, said first upright member curving upwardly from said respective base member when said frame is positioned in said deployed position, said first upright member lying on a plane being coplanar with said rectangle when said frame is positioned in said collapsed position, and a second upright member having a primary end and a secondary end, each of said primary and secondary ends being movably coupled to a respective one of said base members, each of said primary and secondary ends being aligned with a respective one of four corners of said rectangle formed by said base members, said second upright member being positioned on an opposite side of said rectangle with respect to said first upright member, said second upright member curving upwardly from said respective base member when said frame is positioned in said deployed position, said second upright member lying on a plane being coplanar with said rectangle when said frame is positioned in said collapsed position;

said border being coupled to and is coextensive with each of said base members such that said border extends around an entire perimeter of said rectangle formed by said base members, said border having a lower surface, said lower surface resting on a top edge of the carriage when said frame is positioned on the carriage; and each of said fasteners being positioned on said lower surface of said border, said fasteners being spaced apart from each other and being distributed around said perimeter of said rectangle.

2. The assembly according to claim 1, wherein:

said mosquito net has a first end panel, a second end panel and a middle panel;

each of said first and second end panels has an upper edge and a lower edge, said upper edge of each of said first and second end panels being coupled to a respective one of said first and second upright members, said upper edge being coextensive with said respective first and second upright member, said lower edge of each of said first and second end panels being coupled to a respective one of said base members, each of said first and second end panels forming a respective end of said quonset when said frame is positioned in said deployed position.

3. The assembly according to claim 2, wherein said middle panel has a front edge, a back edge, a first lateral edge and a second lateral edge, said first lateral edge being coupled to said first upright member, said second lateral edge being coupled to said second upright member, each of said front and back edges being coupled to a respective one of said base members, said middle panel forming a roof of said quonset when said frame is positioned in said deployed position.

4. A collapsible mosquito net assembly being mountable to a carriage wherein said assembly is configured to protect an occupant from mosquitoes, said assembly comprising:

a frame having a plurality of members being collapsibly coupled together thereby facilitating said frame to be positionable between a collapsed position for storage and a deployed position having said frame defining a quonset, said frame being positionable on top of a carriage when said frame is positioned in said deployed position, said plurality of members comprising:

a plurality of base members, said base members being coupled together and being oriented at right angles with each other such that said base members form a rectangle;

a first upright member having a first end and a second end, each of said first and second ends being movably coupled to a respective one of said base members, each of said first and second ends being aligned with a respective one of four corners of said rectangle formed by said base members, said first upright member curving upwardly from said respective base member when said frame is positioned in said deployed position, said first upright member lying on a plane being coplanar with said rectangle when said frame is positioned in said collapsed position; and a second upright member having a primary end and a secondary end, each of said primary and secondary ends being movably coupled to a respective one of said base members, each of said primary and secondary ends being aligned with a respective one of four corners of said rectangle formed by said base members, said second upright member being positioned on an opposite side of said rectangle with respect to said first upright member, said second upright member curving upwardly from said respective base member when said frame is positioned in said deployed position, said second upright member lying on a plane being coplanar with said rectangle when said frame is positioned in said collapsed position;

a mosquito net being coupled to said frame, said mosquito net covering said quonset defined by said frame when said frame is positioned in said deployed position wherein said mosquito net is configured to protect an occupant of the carriage from mosquitoes, said mosquito net having a first end panel, a second end panel and a middle panel, each of said first and second end panels having an upper edge and a lower edge, said upper edge of each of said first and second end panels being coupled to a respective one of said first and second upright members, said upper edge being coextensive with said respective first and second upright member, said lower edge of each of said first and second end panels being coupled to a respective one of said base members, each of said first and second end panels forming a respective end of said quonset when said frame is positioned in said deployed position, said middle panel having a front edge, a back edge, a first lateral edge and a second lateral edge, said first lateral edge being coupled to said first upright member, said second lateral edge being coupled to said second upright member, each of said front and back edges being coupled to a respective one of said base members, said middle panel forming a roof of said quonset when said frame is positioned in said deployed position;

a border being coupled around said frame, said border being coupled to and being coextensive with each of said base members such that said border extends around an entire perimeter of said rectangle formed by said base members, said border having a lower surface, said lower surface resting on a top edge of the carriage when said frame is positioned on the carriage; and a plurality of fasteners, each of said fasteners being coupled to said border, each of said fasteners releasably engaging the carriage when said frame is positioned on the carriage, each of said fasteners being positioned on said lower surface of said border, said fasteners being spaced apart from each other and being distributed around said perimeter of said rectangle.

* * * * *